US005955873A

United States Patent [19]

Maccarrone et al.

[11] Patent Number: 5,955,873

[45] Date of Patent: Sep. 21, 1999

[54] BAND-GAP REFERENCE VOLTAGE GENERATOR

[75] Inventors: Marco Maccarrone, Palestro; Matteo Zammattio, Milan; Stefano Commodaro, Bogliasco, all of Italy

[73] Assignee: STMicroelectronics S.r.l., Agrate Brianza, Italy

[21] Appl. No.: 08/960,844

[22] Filed: Oct. 30, 1997

[30] Foreign Application Priority Data

Nov. 4, 1996 [EP] European Pat. Off. ..... 96830561

[51] Int. Cl.[6] ..... G05F 3/16

[52] U.S. Cl. ..... 323/314; 323/901; 323/907

[58] Field of Search ..... 323/901, 907, 323/313–316, 281

[56] References Cited

U.S. PATENT DOCUMENTS

| | | | |
|---|---|---|---|
| 4,857,823 | 8/1989 | Bitting | 323/314 |
| 5,084,665 | 1/1992 | Dixon et al. | 323/281 |
| 5,359,281 | 10/1994 | Barrow et al. | 323/284 |
| 5,367,249 | 11/1994 | Honningford | 323/313 |
| 5,453,679 | 9/1995 | Rapp | 323/313 |
| 5,563,504 | 10/1996 | Gilbert et al. | 323/316 |
| 5,610,506 | 3/1997 | McIntyre | 323/313 |
| 5,629,611 | 5/1997 | McIntyre | 323/313 |
| 5,642,037 | 6/1997 | Malherbe | 323/316 |
| 5,703,475 | 12/1997 | Lee et al. | 323/313 |
| 5,789,906 | 8/1998 | Mizuide | 323/313 |

FOREIGN PATENT DOCUMENTS

| | | |
|---|---|---|
| 0 601 540 A1 | 6/1994 | European Pat. Off. . |
| 2 218 544 | 11/1989 | United Kingdom . |

*Primary Examiner*—Peter S. Wong
*Assistant Examiner*—Derek J. Jardieu
*Attorney, Agent, or Firm*—Seed And Berry LLP

[57] ABSTRACT

A band-gap reference voltage generator comprises an operational amplifier comprising a first input and a second input, the first input being coupled to a first feedback network and the second input being coupled to a second feedback network both coupled to an output of the operational amplifier providing a reference voltage. The first feedback network contains an emitter-base junction of first bipolar junction transistor and the second feedback network contains an emitter-base junction of second bipolar junction transistor. A selectively activated current supply supplies a bias current to the operational amplifier, the current supply being deactivatable in a substantially zero power consumption operating condition for turning the reference voltage generator off. A start-up circuit activated upon start-up of the reference voltage generator for a fixed, prescribed time interval forces a start-up current to flow through the first bipolar junction transistor means.

15 Claims, 2 Drawing Sheets

BAND-GAP REFERENCE VOLTAGE GENERATOR

TECHNICAL FIELD

The present invention relates to an improved band-gap reference voltage generator.

BACKGROUND OF THE INVENTION

In integrated circuits the necessity often arises of generating a stable reference voltage.

Band-gap reference voltage generators are known for providing a reference voltage which is insensitive to temperature variations. The general principle on which band-gap reference voltage generators operate is one of cancellation of temperature coefficients: generally, a voltage is developed that is a scaled value of $V_T$ (the so-called "thermal voltage" equal to KT/q, where K is the Boltzmann constant, T is the temperature in Kelvins, and q is the electron charge in absolute value). This scaled value has a well-defined temperature coefficient, that is the scaling constant times the temperature coefficient of $V_T$, which is positive. Said voltage is added to a base-emitter voltage, which in turn has a negative temperature coefficient. The scaling factor is chosen so that the sum of the temperature coefficients is zero. If the output voltage of the circuit is taken in such a way to contain the sum of the scaled value of $V_T$ and of the base-emitter voltage, the temperature coefficient of the output voltage is zero.

Several kinds of band-gap reference voltage generators are known. The most common type comprises an operational amplifier in negative feedback configuration, with the non-inverting and inverting inputs coupled to respective circuit branches which are also connected to the output of the operational amplifier, each branch containing respective base-emitter junctions of bipolar junction transistor.

In some applications, requiring a low power consumption operating mode, the band-gap reference voltage generator must not dissipate power in said operating mode. This is for example the case of 3 V only Flash EEPROM devices when operated in stand-by. For these devices, the power consumption in stand-by condition is required to be strictly zero, and is therefore necessary to turn all the possible sources of consumption off. Whenever it is necessary to have the reference voltage available, it is necessary to wait for the reference voltage generator power up: the power-up delay is typically in the range of microseconds.

SUMMARY OF THE INVENTION

The present invention provides an improved band-gap reference voltage generator featuring an extremely low power-up delay.

The present invention includes a band-gap reference voltage generator comprising an operational amplifier having a first input and a second input, the first input being coupled to a first feedback network and the second input being coupled to a second feedback network, both coupled to an output (7) of the operational amplifier providing a reference voltage. The first feedback network contains an emitter-base junction of first bipolar junction transistor means and the second feedback network contains an emitter-base junction of second bipolar junction transistor means. The reference voltage generator also includes current supplying means for supplying a bias current to the operational amplifier, the current supplying means being deactivatable in a substantially zero power consumption operating condition for turning the reference voltage generator off. The reference voltage generator also includes start-up circuit means activated upon start-up of the reference voltage generator for a fixed, prescribed time interval for forcing a start-up current to flow through the first bipolar junction transistor means.

The features and advantages of the present invention will be made more evident by the following detailed description of a particular embodiment thereof, illustrated as a non-limiting example in the annexed drawings.

DETAILED DESCRIPTION OF THE INVENTION

Figure 1:
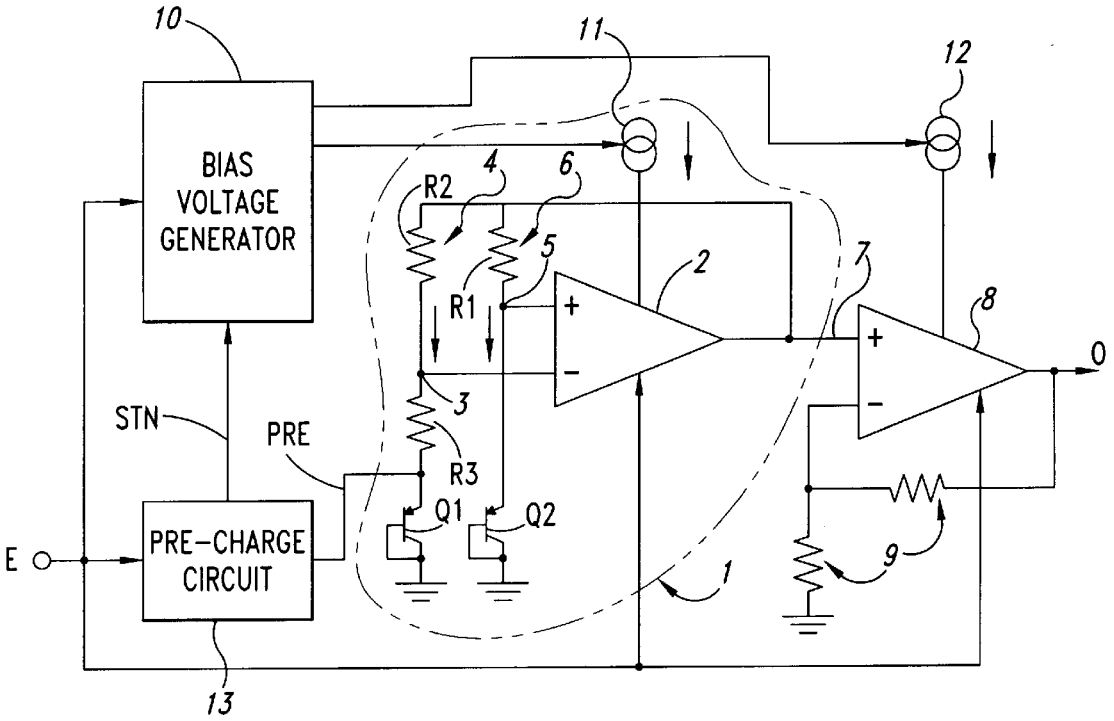
FIG. 1 is a schematic block diagram of a band-gap reference voltage generator according to the present invention, completed with an output buffer circuit.

With reference to the drawings, in FIG. 1 a band-gap reference voltage generator according to the present invention is schematically shown. The circuit comprises a band-gap reference voltage generator 1 comprising an operational amplifier 2 with an inverting input connected to a node 3 of a first feedback circuit branch 4, and a non-inverting input connected to a node 5 of a second feedback circuit branch 6. The first feedback circuit branch 4 comprises two serially-connected resistors R2, R3 and a first diode-connected PNP bipolar junction transistor (BJT) Q1, the second feedback circuit branch 6 comprises a resistor R1 and a second diode-connected PNP BJT Q2.

Q1 and Q2 have different emitter areas. Alternatively, Q1 can be made up by a plurality of serially-connected BJTs identical to Q2.

An output 7 of operational amplifier 2 is supplied to a non-inverting output buffer stage comprising an operational amplifier 8 and a resistive negative feedback loop 9. The output 0 of the operational amplifier 8 forms the reference voltage.

The circuit comprises a bias voltage generator 10 which generates bias voltages for two bias current generators 11, 12, supplying bias currents to the operational amplifiers 2 and 8.

A pre-charge circuit 13 is further provided which generates a pre-charge signal PRE supplied to the emitter of Q1, and a control signal STN which is supplied to the bias voltage generator 10. The pre-charge circuit 13 is supplied by an enable signal E, (which is an external control signal for the band-gap reference voltage generator) which also supplies the bias voltage generator 10 and the operational amplifiers 2 and 8. Signal E is activated, to make the band-gap reference voltage generator operative, and is deactivated to put the band-gap voltage reference generator in a zero power dissipation condition.

Figure 2:
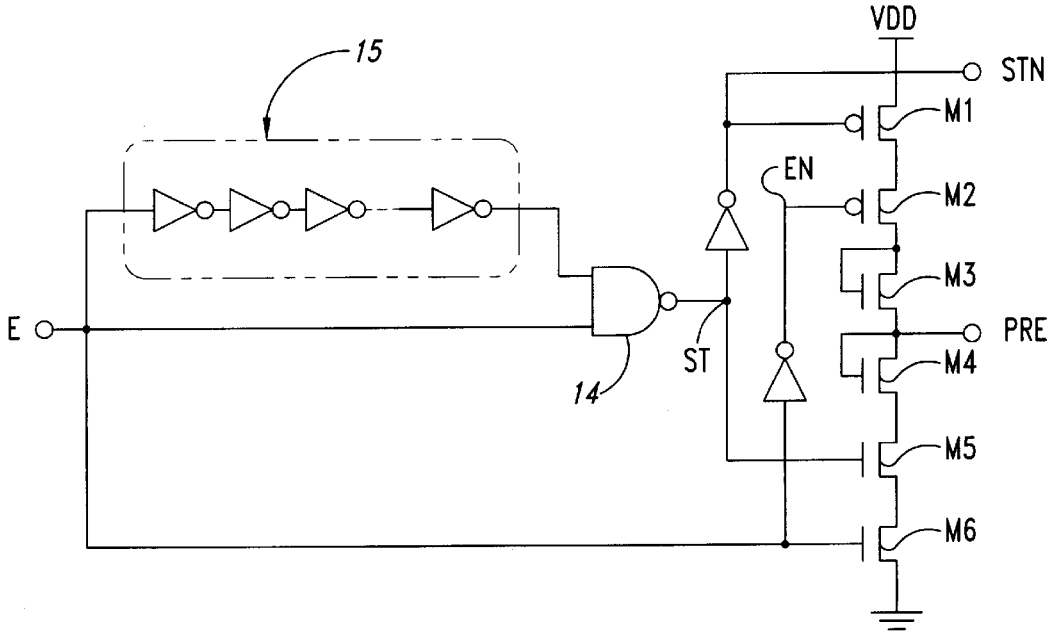
FIG. 2 is a circuit diagram of a pre-charge circuit of the band-gap reference voltage generator of FIG. 1.
Figure 3:
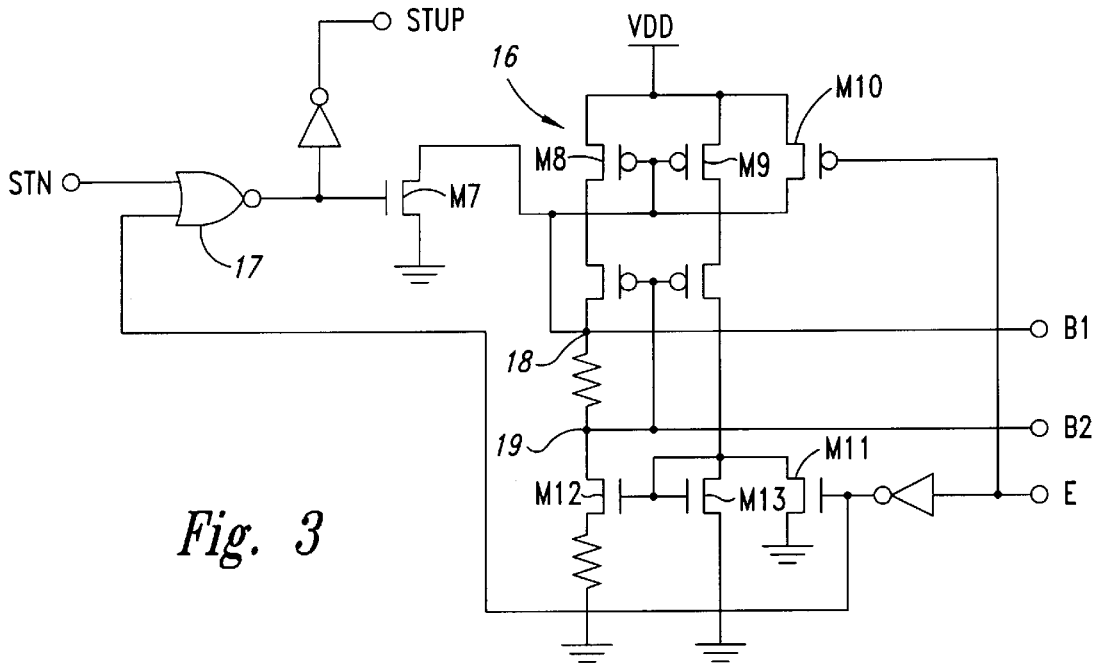
FIG. 3 is a circuit diagram of a bias voltage generator for the band-gap reference voltage generator and the output buffer circuit.

FIG. 2 is a circuit diagram of the pre-charge circuit 13 of FIG. 1. Enable signal E is supplied to a first input of a NAND gate 14 and to a delay line 15, the output of which is supplied to a second input of NAND gate 14. The delay line 15 can be formed in a conventional way by an even number of serially-connected inverters. The circuit further comprises an output voltage divider made up of six MOSFETs M1–M6 connected in series between a voltage supply VDD (for example a 3 V voltage supply) and ground. MOSFETs M1 and M2 are P channel, and are respectively driven by signal STN, which is logic complement of an output signal ST of NAND gate 14, and by a logic complement EN of enable signal E. MOSFETs M3 to M6 are N channel; M3 and M4 are diode-connected, while M5 and M6 are respectively driven by signal ST and signal E. A common node between MOSFETs M3 and M4 forms the output signal PRE of the precharge circuit. FIG. 3 is a circuit diagram of the bias voltage generator 10 shown in FIG. 1. The circuit receives as input signals signal E and signal STN. The circuit comprises a current-mirror 16. Signal STN and a logic complement of signal E supply a NOR gate 17 which controls activation of an N-channel MOSFET M7 to connect the gates of two P-channel MOSFETs M8, M9 of the current mirror to ground; a P-channel MOSFET M10, controlled by signal E, allows to connect the gates of M8 and M9 to the voltage supply VDD when signal E is deactivated (E="0"); similarly, an N-channel MOSFET M11, controlled by the logic complement of signal E, allows to connect the gates of two N-channel MOSFETs M12, M13 of the current mirror 16 to ground when signal E is deactivated (E="0"); MOSFETs M10 and M11 thus assure that, when signal E is deactivated, the current mirror 16 is deactivated and does not sink any current from VDD. The current mirror 16 has two outputs, B1 and B2, which are formed by two distinct nodes 18 and 19 of one of the two branches of the current mirror 16; node 18 is also connected to the gates of M8 and M9, so that it can be pulled to ground when M7 is activated. The bias voltage generator has a further output signal STUP which is the logic complement of the output signal of NOR gate 17.

Figure 4:
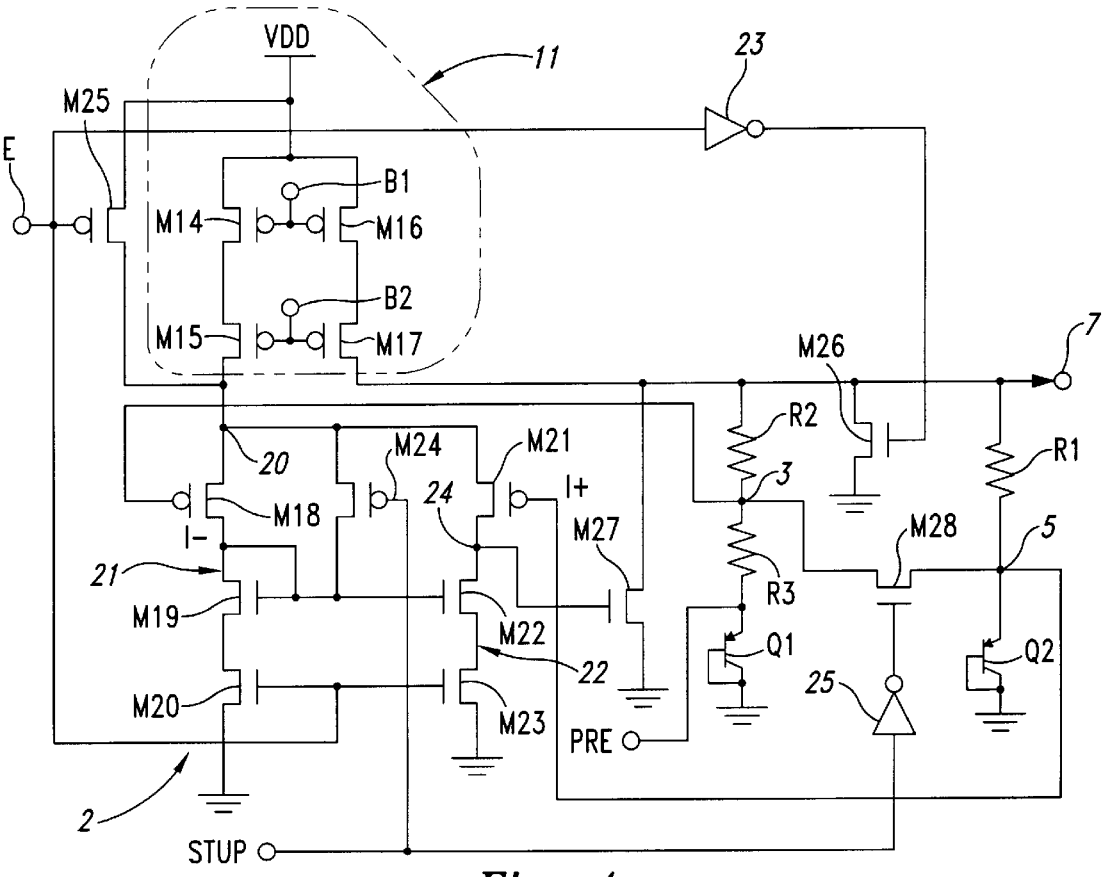
FIG. 4 is a circuit diagram of the band-gap voltage generator of FIG. 1.

FIG. 4 is a circuit diagram of the band-gap reference voltage generator shown schematically in FIG. 1. In this figure, the detailed circuit structure of the bias current generator 11 is also shown. The bias current generator 11 is a current-mirror with two branches, each containing two serially-connected P-channel MOSFETs M14, M15 and M16, M17. M14 and M16 are controlled by signal B1, while M15 and M17 are controlled by signal B2. A first branch of the current mirror is connected between VDD and a supply node 20 of the operational amplifier 2. The operational amplifier 2 is made up of two branches 21 and 22, connected in current-mirror configuration. Branch 21 comprises a P-channel MOSFET M18 and two N-channel MOSFETs Ml9, M20; branch 22 similarly comprises a P-channel MOSFET M21 and two N-channel MOSFETs M22, M23. The gate of M18 and M21 respectively form the inverting input I− and the non-inverting input I+ of the operational amplifier. MOSFETs M19 and M22, and MOSFETs M20 and M23, have the gates connected to each other. Connected between the gates of M19 and M22 and the supply node 20 is a P-channel MOSFET M24 controlled by signal STUP. The gates of M20 and M23 are controlled by signal E; signal E also controls a P-channel MOSFET M25 connected between VDD and the supply node 20. A common node 24 in branch 22 between M21 and M22 drives an N-channel MOSFET M27 with source connected to ground and drain connected to a second branch of the bias current generator 11; the drain of M27 also forms the output 7 of the operational amplifier. Signal E controls, through an inverter 23, an N-channel MOSFET M26 connected between the output 7 and ground. Signal STUP controls, through an inverter 25, an N-channel MOSFET M28 connected between nodes 3 and 5 of the two negative feedback branches.

The operation of the circuit previously described will be now explained.

In stand-by condition, signal E is deactivated ("0"); in the pre-charge circuit 13 MOSFETs M6 and M2 are off, and signal STN is low ("0"); in the bias voltage generator 10 MOSFETs M11, M10 are on, while M7 is off; MOSFETs M12 and M13 are off and no current flows in the two branches of the current mirror 16; bias voltages B1 and B2 are kept to VDD by M10; since both E and STN are low, signal STUP is high ("1"). The bias current generator 11 is off because MOSFETs M14 to M17 are all off; similarly, also the bias current generator 12 is off. The power consumption is zero.

When signal E goes high ("1"), M6 and M2 in the pre-charge circuit 13 turn on; the "0" to "1" transition of signal E does not immediately propagate through the delay line 15 to the other input of NAND 14, so that signal ST remains high for a prescribed time. In this condition, MOSFETs M1 to M6 are all on, and the output signal PRE is set to a value intermediate between VDD and ground, depending on the resistivities of the MOSFETs; a suitable value can be for example approximately equal to 0.6 V. When, after the prescribed time delay (e.g., 20 ns) introduced by the delay line 15 the "0" to "1" transition reaches the other input of NAND 14, signal ST goes low, turning off MOSFETs M1 and M5. Signal PRE is no more coupled to VDD, and falls to the VBE value of Q1. Thus, upon activation of signal E, a voltage pulse of a prescribed duration is generated at signal PRE.

The activation of signal E turns M10 and M11 off; after activation of signal E and before signal STN goes high, signal STUP is low and MOSFET M7 is turned on, thus connecting the gates of M8 and M9 to ground and pulling bias voltages B1 and B2 to values approximately equal to ground; in this way, a strong start is imposed to the current flowing through the two branches of current mirror 16, so that bias voltages B1 and B2 can quickly reach their steady-state value. Bias voltages B1 and B2 turn the bias current generators 11 and 12 on, and the operational amplifiers 2 and 8 are powered. As long as signal STUP remains low, MOSFETs M24 and M28 in FIG. 4 are turned on. MOSFET M24 unbalances the two branches 21 and 22 of the operational amplifier 2, so to prevent conditions of zero currents flowing through such two branches; MOSFET M28 equalizes the inverting and non-inverting inputs I− and I+ of the operational amplifier; at the same time, the voltage pulse on signal PRE is applied to the emitter of BJT Q1. In this way, it is possible to prevent a situation wherein the currents flowing through the feedback branches 4 and 6 are both zero from occurring; this condition is a stable operating condition in conventional band-gap reference voltage generators, and determines the lengthening of the start-up time.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A band-gap voltage reference generator, comprising:

an operational amplifier having first and second inputs and an output;

a first resistive feedback network coupled between the output and the first input;

a second resistive feedback network coupled between the output and the second input;

a first diode-configured semiconductor element coupled between the first input and a circuit reference;

a second diode-configured semiconductor element coupled between the second input and the circuit reference;

a current generator coupled to the operational amplifier to supply the operational amplifier with electrical current for operation, the current generator including an enable input terminal to selectively activate the current generator wherein the operational amplifier operates in a normal operational mode when the enable input terminal is selectively activated and, when the enable terminal is not activated, the operational amplifier is non-operational and consumes no power; and a start-up circuit, electrically coupled to the first diode-configured semiconductor element, to provide a start-up current to the first diode-configured semiconductor element for a predetermined period of time after the enable input terminal is selectively activated.

2. The voltage generator of claim 1 wherein the start-up circuit comprises a semiconductor voltage divider coupled between a power supply voltage and the circuit reference, the voltage divider generating a pre-charge voltage intermediate between the supply voltage and the circuit reference, the pre-charge voltage being applied to the first diode-configured semiconductor element for the predetermined period of time after the enable input terminal is selectively activated.

3. The voltage generator of claim 2, further including an activation circuit coupled to the enable input terminal and the semiconductor voltage divider to activate the voltage divider for the predetermined period of time after the enable input terminal is selectively activated and to deactivate the activation circuit after the predetermined period of time.

4. The voltage generator of claim 3 wherein the activation circuit comprises a digital logic delay circuit coupled to the enable input terminal to generate a first logic level for the predetermined period of time after the enable input terminal is selectively activated and to generate a second logic level after the predetermined period of time.

5. The voltage generator of claim 4 wherein the digital logic delay circuit includes an even number of logic inverters coupled in series to generate a delay time corresponding to the predetermined period of time.

6. The voltage generator of claim 1 wherein the operational amplifier comprises first and second input branches coupled to the first and second inputs, respectively, the first and second branches comprising a plurality of transistors connected in a current mirror configuration.

7. The voltage generator of claim 6, further including a transistor coupled between the first and second input branches to unbalance the first and second input branches for the predetermined period of time after the enable input terminal is selectively activated.

8. The voltage generator of claim 1, further including a transistor coupled between the first and second inputs, the transistor being activated for the predetermined period of time after the enable input terminal is selectively activated to equalize potentials at the first and second inputs.

9. A band-gap reference voltage generator comprising:

an operational amplifier having a first input and a second input, the first input being coupled to a first feedback network and the second input being coupled to a second feedback network, both feedback networks being coupled to an output of the operational amplifier providing a reference voltage;

an emitter-base junction of a first bipolar junction transistor within the first feedback network;

an emitter-base junction of a second bipolar junction transistor within the second feedback network;

current supplying means for supplying a bias current to the operational amplifier, the current supplying means being deactivatable in a substantially zero power consumption operating condition for turning the reference voltage generator off; and start-up circuit means, activated upon start-up of the reference voltage generator for a fixed, prescribed time interval, for forcing a start-up current to flow through the first bipolar junction transistor.

10. The band-gap reference voltage generator of claim 9 wherein the start-up circuit comprises a voltage divider for generating a pre-charge voltage intermediate between a supply voltage and ground, the pre-charge voltage being applied to the emitter-base junction of the first bipolar junction transistor.

11. The band-gap reference voltage generator of claim 10, further including circuit means for activating the voltage divider upon start-up of the reference voltage generator and for deactivating the voltage divider after a prescribed time interval.

12. The band-gap reference voltage generator of claim 10, further including equalizing means activated during said prescribed time interval for equalizing potentials of said first and second inputs of the operational amplifier.

13. The band-gap reference voltage generator of claim 10 wherein the operational amplifier comprises first and second input circuit branches connected in current-mirror configuration, the band-gap reference voltage generator further including unbalancing means activated during said prescribed time interval for unbalancing the first and second input circuit branches of the operational amplifier.

14. The band-gap reference voltage generator of claim 10, further including a bias voltage generator generating at least a first bias voltage for the current supplying means and comprising first means for turning the bias voltage generator off in the substantially zero power consumption operating mode.

15. The band-gap reference voltage generator of claim 14, further including a current-mirror circuit in the bias voltage generator and second means activated in the prescribed time interval for determining an extra current flow through branches of the current mirror circuit.

* * * * *